US007643266B2

(12) United States Patent
Kammerer et al.

(10) Patent No.: US 7,643,266 B2
(45) Date of Patent: Jan. 5, 2010

(54) TRIGGER CIRCUIT FOR AN ELECTROMAGNETIC ACTUATOR

(75) Inventors: Bernd Kammerer, Gladbach (DE); Hans Adams, Leverkusen (DE)

(73) Assignee: Erben Kammerer KG, Bergisch Gladbach (DE)

( * ) Notice: Subject to any disclaimer, the term of this patent is extended or adjusted under 35 U.S.C. 154(b) by 0 days.

(21) Appl. No.: 11/858,506

(22) Filed: Sep. 20, 2007

(65) Prior Publication Data

US 2008/0074821 A1 Mar. 27, 2008

(30) Foreign Application Priority Data

Sep. 23, 2006 (DE) ..... 20 2006 014 672 U

(51) Int. Cl.
*H01H 50/12* (2006.01)

(52) U.S. Cl. ..... 361/205

(58) Field of Classification Search ..... 361/205, 361/161

See application file for complete search history.

(56) References Cited

U.S. PATENT DOCUMENTS 3,530,455 A 9/1970 Ressler
3,609,732 A * 9/1971 Kasahara et al. ..... 340/634
4,538,137 A * 8/1985 Kimura ..... 340/512
7,057,871 B2 6/2006 Adams

FOREIGN PATENT DOCUMENTS

| | | |
|---|---|---|
| DE | 2601817 | 9/1977 |
| EP | 1 498 912 | 1/2005 |
| GB | 1216339 | 12/1970 |
| GB | 2123207 | 1/1984 |

OTHER PUBLICATIONS

European Search report for corresponding application No. EP 07116570.8 completed Feb. 12, 2009.

* cited by examiner

*Primary Examiner*—Ronald W Leja
(74) *Attorney, Agent, or Firm*—Renner, Otto, Boisselle & Sklar LLP

(57) ABSTRACT

A trigger circuit comprises a first series circuit (16) defined by an electronic switch (17) and an electromagnetic actuator (10). A second series circuit (18) defined by a resistor (19) and a sensor (20) responding to danger situations is arranged in parallel to said first series circuit (16). A tap (24) of said second series circuit (18) is connected with a control electrode (25) of said electronic switch (17). The circuit is of simple configuration and ensures a reliable switching behavior. Even when said sensor (20) is closed again, the trigger state is maintained.

4 Claims, 1 Drawing Sheet

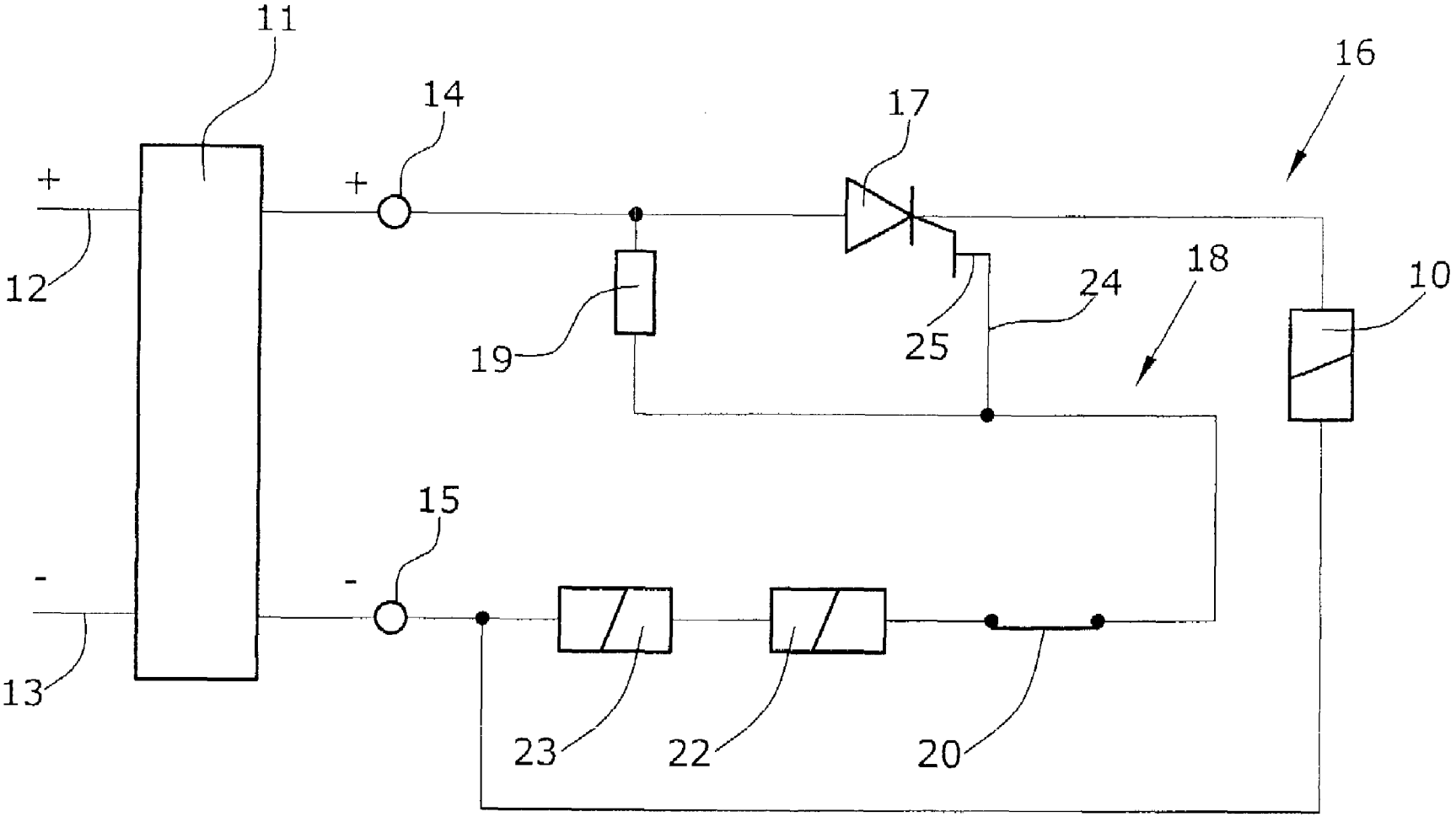
10
16
18
24
25
17
20
22
23
19
14
15
+
-
11
+
12
-
13

TRIGGER CIRCUIT FOR AN ELECTROMAGNETIC ACTUATOR

BACKGROUND OF THE INVENTION

1. Field of the Invention

The present invention relates to a trigger circuit for an electromagnetic actuator, comprising an energy storage located in the vicinity of the actuator, said energy storage being connected with a remotely arranged supply source via supply lines, at least one electronic switch defining, together with the actuator, a first series circuit, and a sensor responding to danger situations.

2. Description of Related Art

Trigger circuits for electromagnetic actuators are frequently used in the vicinity of potentially explosive areas, for example in the chemical industry. Typical electromagnetic actuators are actuators for valves, e.g. linear actuators for shutoff valves. In protective systems, these valves serve for very rapidly switching on or off mass and volume flows, or for very rapidly pre-controlling suitable shutoff devices and thus performing switching actions. The operation of electromagnetic actuators requires a very high power to be provided for a short time. If the energy required for the switching action must be transmitted through the potentially explosive area, the power involved must be transmitted in an explosion-protected manner.

For preventing high currents from flowing through the supply lines, it is common practice to arrange an energy storage in the vicinity of the electronic switch and, if the sensors responds, to discharge the energy storage via the series circuit defined by the then closed electronic switch and the actuator.

One aspect of the present invention is based on a trigger circuit of EP 1 498 912 A1 of the applicant company. The trigger circuit described here comprises two electronic switches connected in series with the actuator in the form of triacs. The triacs are controlled via optocouplers. The trigger command for operating the actuator has the effect that a polarity inversion of the supply voltage takes place, which is transmitted to the optocoupler. The known trigger circuit is expensive on the one hand, and susceptible to malfunction on the other hand, in particular since light emitting diodes and light-sensitive transistors may fail.

SUMMARY OF THE INVENTION

It is an object of the invention to provide a trigger circuit for an electromagnetic actuator, which has a simple configuration and ensures a reliable switching function and maintenance of an adopted switching state.

In the trigger circuit according to the invention, the sensor defines, together with at least one resistor, a second series circuit arranged in parallel to the first series circuit; a tap of the second series circuit is connected with an ignition electrode of the electronic switch.

The trigger circuit according to the invention is characterized by its great simplicity. Further, said circuit is inexpensive since only a few components are required. In the case of danger, the second series circuit is interrupted by opening the sensor. This leads to a shift of electric potential in the ignition electrode of the electronic switch such that now a current flows via the ignition electrode, said current exceeding a switching threshold, thus igniting the switch. In this manner, a reliable operation of the actuator is performed with only a few components.

If the electronic switch is a thyristor, said thyristor offers the further advantage that it does not extinguish after having been ignited, and cannot be switched off even when the switch is closed again. It is thus ensured that after triggering of the actuator, said actuator stays in the triggered state, independent of the sensor state.

Preferably, the electronic switch is a glass-passivated semiconductor switch. By glass passivation a cover is formed which protects the semiconductor switch against external influences, such as dust and aggressive media.

BRIEF DESCRIPTION OF THE DRAWINGS

An embodiment of the invention will now be described in greater detail with reference to the only FIGURE of the drawing.

The drawing shows a schematic circuit diagram of the trigger circuit.

DETAILED DESCRIPTION OF THE PREFERRED EMBODIMENT OF THE INVENTION

The trigger circuit serves for operating an electronic actuator 10 which is a relay or an actuating element for adjusting a slider in a liquid or gas conduit, for example. In the vicinity of the actuator 10 an energy storage 11 is located which supplies the trigger circuit with the energy required for operating the actuator. The energy storage 11 is described in detail in EP 1 498 912 A2 and is thus not explained here. Said energy storage 11 includes an LC battery and a voltage multiplier, and defines a controlled current: or voltage source with a limited output variable. Here, the energy storage 11 is shown as a quadripole. Its input terminals are connected to supply lines 12,13 extending to a remotely arranged energy source (not shown). The energy source is a direct current source for charging the energy storage.

The energy storage 11 comprises a positive pole 14 and a negative pole 15 at its output side. Between the two poles a first series circuit 16 defined by an electronic switch 17 and the actuator 10 is located. A second series circuit 18 is arranged in parallel to the first series circuit 16, said second series circuit 18 also being arranged between the poles 14,15. The second series circuit 18 includes, as seen from the positive pole 14, a resistor 19, a sensor 20, an indicating relay 22 and a quiescent current relay 23. Here, the value of the resistor 19 is 470 ohms, and each of the two relays 22,23 has a resistance of 270 ohms, such that the resistance of the second series circuit 18 amounts to a total of approximately 1 kilohom.

Between the resistor 19 and the sensor 20 the second series circuit 18 is provided with a tap 24 which is connected with a control electrode 25 (gate) of the switch 17.

In the present embodiment, the relays 22,23 are arranged on the sensor side of the tap 24. They may also be disposed immediately adjacent to the resistor 19 on the resistor side.

The sensor 20 may be a fire sensor, pressure sensor, temperature sensor and the like, for example. It is further possible to use a plurality of different sensor types which are connected in series in the second series circuit 18.

Now the function of the trigger circuit is described: in the normal state, the sensor 20 is closed, i.e. the second series circuit 18 defines a closed quiescent current circuit. The current flows from the positive pole 14 to the negative pole 15 via the resistor 19, the sensor 20 and the relays 22,23. The switch 17 is closed.

In the case of danger, the sensor 20 is opened such that the potential at the control electrode 25 becomes positive, while a cathode of the switch 17 is negative. Thus, the thyristor is ignited, and now current flows through the first series circuit 16, namely via the actuator 10. When the sensor 20 is subsequently closed, the conductive state of the first series circuit 16 is maintained.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A trigger circuit for an electromagnetic actuator, comprising an energy storage arranged in the vicinity of said actuator, wherein the energy storage comprises a controlled DC current or voltage source with a limited output, said energy storage being connected with a remotely disposed supply source via supply lines, at least one thyristor having an anode, a cathode and a gate and defining, together with said actuator, a first series circuit, and a sensor responding to danger situations, wherein said sensor, together with at least one resistor, defines a second series circuit arranged in parallel to said first series circuit, and a tap of said second series circuit is connected with said gate of said thyristor, wherein the at least one resistor connects the anode and the gate of the thyristor, and wherein the sensor in case of sensing a danger situation, opens the second series circuit.

2. The trigger circuit according to claim 1, wherein the second series circuit includes an indicating relay and/or a quiescent current relay on the resistor side or on the sensor side in relation to the tap.

3. The trigger circuit according to claim 1, wherein the first and the second series circuit are connected to the output terminals of the energy storage.

4. The trigger circuit according to claim 1, wherein the thyristor is a glass-passivated semiconductor switch.

* * * * *